US011355827B2

(12) United States Patent
Dani

(10) Patent No.: US 11,355,827 B2
(45) Date of Patent: Jun. 7, 2022

(54) RADIO FREQUENCY DEVICE WITH NON-UNIFORM WIDTH CAVITIES

(71) Applicant: KNOWLES CAZENOVIA, INC., Cazenovia, NY (US)

(72) Inventor: Hassan Dani, Cazenovia, NY (US)

(73) Assignee: KNOWLES CAZENOVIA, INC., Cazenovia, NY (US)

( * ) Notice: Subject to any disclaimer, the term of this patent is extended or adjusted under 35 U.S.C. 154(b) by 108 days.

(21) Appl. No.: 16/787,286

(22) Filed: Feb. 11, 2020

(65) Prior Publication Data

US 2020/0259263 A1 Aug. 13, 2020

Related U.S. Application Data

(60) Provisional application No. 62/805,199, filed on Feb. 13, 2019.

(51) Int. Cl.

| | |
|---|---|
| ***H01P 1/203*** | (2006.01) |
| ***H01P 1/212*** | (2006.01) |
| ***H01P 1/208*** | (2006.01) |

(52) U.S. Cl.

CPC ..... *H01P 1/203* (2013.01); *H01P 1/2088* (2013.01); *H01P 1/212* (2013.01)

(58) Field of Classification Search

CPC .. H01P 1/203; H01P 1/20327; H01P 1/20336; H01P 1/20354; H01P 1/20363; H01P 1/20372; H01P 1/20381; H01P 1/2088; H01P 1/212

See application file for complete search history.

(56) References Cited

U.S. PATENT DOCUMENTS

| | | | |
|---|---|---|---|
| 6,486,748 | B1 | 11/2002 | Stones et al. |
| 2007/0109076 | A1 | 5/2007 | Knecht et al. |
| 2014/0340176 | A1 | 11/2014 | Oran |
| 2018/0226936 | A1 | 8/2018 | Jing et al. |

FOREIGN PATENT DOCUMENTS

| | | | |
|---|---|---|---|
| JP | 2003-289204 | A | 10/2003 |
| WO | WO-2005/074069 | A1 | 8/2005 |

OTHER PUBLICATIONS

International Search Report and Written Opinion, PCT/US2020/017583, Knowles Cazenovia, Inc. (dated May 11, 2020).

*Primary Examiner* — Stephen E. Jones
(74) *Attorney, Agent, or Firm* — Foley & Lardner LLP

(57) ABSTRACT

A microwave or radio frequency (RF) device includes a substrate and a cover. The substrate has a first surface and an opposing second surface, the first surface including a first RF component and a second RF component electrically coupled to the first RF component in series. The cover is disposed over the first surface of the substrate, where the cover includes a first portion with a first width covering the first RF component, where the first portion and the first surface define a first waveguide cavity having the first width, and a second portion with a second width, less than the first width, covering the second RF component, where the second portion and the first surface define a second waveguide cavity having the second width.

18 Claims, 6 Drawing Sheets

RADIO FREQUENCY DEVICE WITH NON-UNIFORM WIDTH CAVITIES

CROSS-REFERENCE TO RELATED APPLICATIONS

This application for patent claims benefit under § 119(e) to U.S. Provisional Application No. 62/805,199, filed Feb. 13, 2019, entitled "RADIO FREQUENCY DEVICE WITH NON-UNIFORM WIDTH CAVITIES," the entire contents of which are incorporated herein by reference.

BACKGROUND

Microwave and radio-frequency (RF) circuits can include components such as filters that can filter an input signal to generate a filtered output signals. The filters can include, for example, band-pass filters, high-pass filters, low-pass filters etc.

SUMMARY

In an embodiment, a radio frequency device includes a substrate and a cover. The substrate has a first surface and an opposing second surface, the first surface including a first RF component and a second RF component electrically coupled to the first RF component in series. The cover is disposed over the first surface of the substrate, where the cover includes a first portion with a first width covering the first RF component, where the first portion and the first surface define a first waveguide cavity having the first width, and a second portion with a second width, less than the first width, covering the second RF component, where the second portion and the first surface define a second waveguide cavity having the second width. The cover is sometimes referred to as a stepped cover.

In some embodiments, the first RF component comprises a band-pass filter exhibiting one or more harmonics in a first frequency range. In some embodiments, the second RF component comprises a low-pass filter having a cut-off frequency below the first frequency range. In some embodiments, the first portion of the cover includes a first sidewall and a second sidewall, and wherein the second portion includes a third sidewall and a fourth sidewall. In some embodiments, the first sidewall is separated from the third sidewall by a first gap. In some embodiments, the second sidewall is separated from the fourth sidewall by a second gap. In some embodiments, the first gap is equal to the second gap. In some embodiments, the first sidewall is continuous with the third sidewall. In some embodiments, the second sidewall is separated from the fourth sidewall by a gap.

In some embodiments, the first surface of the substrate defines a first slot and a second slot, wherein at least a portion of the third sidewall is disposed in the first slot and a at least a portion of the fourth sidewall is disposed in the second slot. In some embodiments, the first sidewall and the second sidewall are separated from a perimeter of the first RF component by at least a first distance. In some embodiments, the first distance is at least 0.008 inches.

In some embodiments, the substrate includes a ground plane disposed on the second surface. In some embodiments, the substrate includes, a plurality of side surfaces that extend between the first surface and the opposing second surface, and conductive material disposed on at least a portion of the plurality of side surfaces, the conductive coating electrically connected to the ground plane. In some embodiments, at least a portion of the first sidewall and at least a portion of the second sidewall are in contact with the conductive material.

In some embodiments, the first portion includes a first top plate that extends between the first sidewall and the second sidewall, the first top plate covering the first RF component. In some embodiments, the second portion includes a second top plate that extends between the third sidewall and the fourth sidewall, the second top plate covering the second RF component. In some embodiments, the first top plate is continuous with the second top plate. In some embodiments, the first portion of the cover and the second portion of the cover have a first height and a second height, respectively, in relation to the first surface of the substrate, wherein the first height is equal to the second height. In some embodiments, the first width has a value between 0.2 inches and 0.4 inches, and the second width has a value between 0.1 inches and 0.4 inches.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
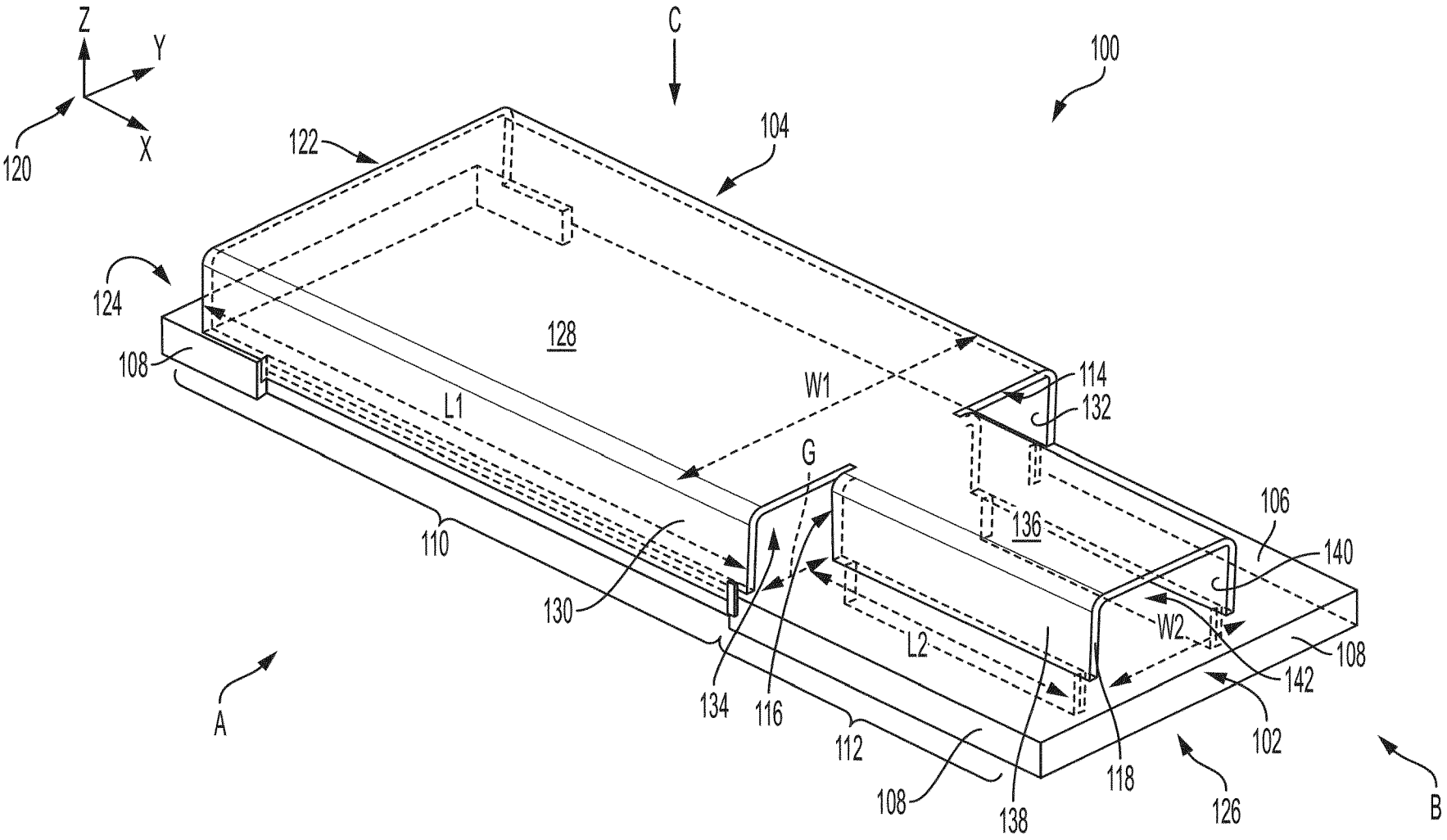
FIG. 1 shows a RF device having a non-uniform width cover according to embodiments of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present disclosure describes devices and techniques for signal processing using microwave or radio frequency (RF) devices (collectively referred to herein as "RF devices"). The RF devices can include a substrate having at least one ground plane and a signal terminal. One or more RF circuits can be formed on the substrate, where the RF circuits can include components such as filters, amplifiers, resonators, phase shifters, etc.

In some instances, the RF devices can include filters such as a band-pass filter, which can include, provide and/or define a pass-band in the frequency spectrum. The band-pass filter can attenuate frequency components of an input signal that lie outside of the pass-band. However, the frequency response of the band-pass filter can have repeated pass-bands at frequencies higher than the desired pass-band. Such high frequency pass-bands can be referred to as harmonics, and can undesirably introduce high frequency components of the input signal into the output signal. One approach to mitigating or suppressing the effect of harmonics in the pass-band frequency response is to cascade a low-pass filter with the band-pass filter (e.g., to form a combined band-pass and low-pass filter), where the cut-off frequency of the low-pass filter can be positioned below the frequency of the harmonics. However, the suppression by the low-pass filter is often inadequate. One approach to improving the suppression offered by the low-pass filter is to make the frequency roll-off of the low pass filter steeper. This can be achieved, for example, by adding additional resonators, or using a slow wave structure. However, these approaches can result in an increase in the size of the filter (and in turn the RF device), which is undesirable.

One solution to improving the suppression of the harmonics is to utilize a narrower channel cavity (sometimes referred to herein as a cavity or waveguide cavity) for the low-pass filter. Both the band-pass filter and the low-pass filter can be covered with a cover that extends from an input terminal to an output terminal of the combined band-pass and low-pass filter. However, a width of the cover over the low-pass filter can be less or narrower than the width of the cover over the band-pass filter. This narrower width of the cover over the low-pass filter results in a reduction and/or narrowing in the channel cavity over the low-pass filter, resulting in a shift in the dominant resonance mode and a shift in the harmonics to higher frequencies. As a result, the attenuation of the harmonics increases considerably.

FIG. 1 shows a RF device 100 having a non-uniform width cover 104. The RF device 100 can include a substrate 102 and a cover 104 disposed on the substrate 102. Specifically, the substrate can include a first surface 106, an opposite second surface (not shown) and a plurality of side surfaces 108 that extend between the first surface 106 and the second surface. The substrate 102 can have a first end 124 and an opposing second end 126. The first end 124 and the second end 126 of the substrate 102 can be the ends of the substrate 102 along an x-axis of the Cartesian reference frame 120. An input port (not shown) can be located at the first end 124 and an output port (not shown) can be located at the second end 126 of the substrate 102, for example, or the other way around. The substrate 102 can include a RF circuit (shown in FIG. 5) for processing a RF signal. In some examples, the RF circuit can include one or more RF circuit components. For example, the RF circuit can include a band-pass filter and a low-pass filter. However, the band-pass filter and low-pass filter are only examples, and the RF circuit can additionally or alternatively include other RF circuit components such as amplifiers, tuners, resonators, etc.

The cover 104 is positioned on the first surface 106 of the substrate 102. The cover 104 can be monolithic (e.g., fabricated as a single piece), or can comprise multiple sections physically coupled together. The cover 104 can cover the RF circuit on the substrate 102. Specifically, the cover 104 can cover the RF circuit components of the RF circuit. For example, a first portion 110 of the cover 104 covers the band-pass filter, and a second portion 112 covers the low-pass filter. The first portion 110 of the cover 104 can extend between a first end 122 and a second end 114 of the first portion 110 of the cover 104. The first end can be positioned adjacent the first end 124 of the substrate 102 and the second end 114 can be positioned nearer to the second end 126 of the substrate than the first end 122 of the first portion 110. The second portion 112 of the cover 104 can extend between a first end 116 and a second end 118 of the second portion 112. The first end 116 of the second portion 112 can be joined with (or can extend into) the second end 114 of the first portion 110. The second end 118 of the second portion 112 can be positioned nearer the second end 126 of the substrate 102 than the first end 116 of the second portion 112 of the cover 104.

The first portion 110 can include a first top plate 128, a first sidewall 130 and a second sidewall 132. The first top plate 128 extends between the first end 122 and the second end 114 of the first portion 110. A plane of the first top plate 128 can be parallel to the plane of the substrate 102. The first sidewall 130 and the second sidewall 132 can extend away from the sides of the first top plate 128 other than the sides at the first end 122 and/or the second end 114 for example. The first sidewall 130 and the second sidewall 132 can be perpendicular to the first top plate 128. In some examples, the first sidewall 130 and the second sidewall 132 can form an acute or an obtuse angle with the first top plate 128. The first sidewall 130 and the second sidewall 132 can be attached to the substrate 102. For example, at least a portion of the first sidewall 130 and/or the second sidewall 132 can be attached to the side surface(s) 108 of the substrate 102 and/or be positioned within corresponding slot(s), opening (s), or aperture(s), defined by the first surface 106 of the substrate 102. At least another portion of the first sidewall 130 and the second sidewall 132 can be in contact with the first surface 106 of the substrate 102. At least a portion (e.g., edge or surface) of the slot(s) and/or side surface(s) 108 of the substrate 102 can include or be coated with a conductive material, which can electrically connect the first sidewall 130 and/or the second sidewall 132 to a ground plane. The first top plate 128, the first sidewall 130, the second sidewall 132 and a portion of the first surface 106 of the substrate 102 below the first top plate 128 can define a first cavity 134. In some examples, the entire first end 122 and the second end 114 of the first portion 110 can be open, i.e., the first portion 110 may not include a sidewall lateral or perpendicular to the first sidewall 130 or the second sidewall 132 at the first end 122 and the second end 114 of the first portion 110.

The first portion 110 can have a first length L1 defined by a distance between the first end 122 and the second end 114 of the first portion 110. The first length L1 can be measured, for example, along the x-axis of the Cartesian reference frame 120. The first portion 110 can have a first width W1 defined by a distance between the first sidewall 130 and the second sidewall 132. The first width W1 can be measured, for example, along the y-axis of the Cartesian reference frame 120. The first length L1 can be greater than the first width W1. However, in some examples, the first length L1 can be equal to or less than the first width W1.

The second portion 112 can include a second top plate 136, a third sidewall 138 and a fourth sidewall 140. The second top plate 136 can extend between the first end 116 and the second end 118 of the first portion 110. A plane of the second top plate 136 can be parallel to the plane of the substrate 102. The third sidewall 138 and the fourth sidewall 140 can extend away from the sides of the second top plate 136 other than the sides at the first end 116 and/or the second end 118 for instance. The third sidewall 138 and the fourth sidewall 140 can be perpendicular to the second top plate 136. In some examples, the third sidewall 138 and the fourth sidewall 140 can form an acute or an obtuse angle with the second top plate 136. The third sidewall 138 and the fourth sidewall 140 can be attached to the substrate 102. For example, at least a portion of the third sidewall 138 and/or the fourth sidewall 140 can be positioned within or be in contact with corresponding slot(s), opening(s), or aperture (s), defined by the first surface 106 of the substrate 102, and/or be in contact with side surface(s) 108 of the substrate 102. At least another portion of the third sidewall 138 and/or the fourth sidewall 140 can be in contact with the first surface 106 of the substrate 102. At least a portion (e.g., edge or surface) of the slot(s) and/or side surface(s) 108 of the substrate 102 can be coated with a conductive material, which can electrically connect the third sidewall 138 and/or the fourth sidewall 140 to a ground plane. The second top plate 136, the third sidewall 138, the fourth sidewall 140 and a portion of the first surface 106 of the substrate 102 below the second top plate 136 can define a second cavity 142. In some examples, the entire first end 116 and/or the entire second end 118 of the second portion 112 can be open, i.e., the second portion 112 may not include a sidewall lateral to the third sidewall 138 or the fourth sidewall 140 at the first end 116 and/or the second end 118 of the second portion 112

The second portion 112 can have a second length L2 defined by a distance between the first end 116 and the second end 118 of the second portion 112. The second length L2 can be measured, for example, along the x-axis of the Cartesian reference frame 120. The second portion 112 can have a second width W2 defined by a distance between the third sidewall 138 and the fourth sidewall 140. The second width W2 can be measured, for example, along the y-axis of the Cartesian reference frame 120. The second length L2 can be greater than the second width W2. However, in some examples, the second length L2 can be equal to or less than the second width W2. The second width W2 of the second portion 112 can be less than the first width W1 of the first portion 110. That is, the first cavity 134 defined by the first portion 110 can be wider than the second cavity 142 defined by the second portion 112. Stated another way, the second cavity 142 defined by the second portion 112 of the cover 104 can be narrower than the first cavity 134 defined by the first portion 110 of the cover 104. As discussed below, the narrower second cavity 142 formed by the second portion 112 can result in a low-pass filter with increased attenuation.

The first top plate 128 can be continuous with the second top plate 136. For example, the second end 114 of the first portion 110 of the cover 104 can abut the second portion 112 of the cover 104. In some examples, the first top plate 128 can be separate from the second top plate 136. That is, there can be a separation or a gap between the first top plate 128 and the second top plate 136. The first portion 110 and the second portion 112 of the cover 104 can have the same or different material(s), thickness(es), surface texture(s), porosity/porosities, layer structure(s), coating(s), and so on.

The first sidewall 130 of the first portion and the third sidewall 138 of the second portion 112 can be separated by a distance G (e.g., by a gap with the distance G). The distance G can be measured for example as a perpendicular distance between a plane of the first sidewall 130 and a plane of the third sidewall 138. The distance can be measured along the y-axis of the Cartesian reference frame 120. In one example, the distance between the first sidewall 130 and the third sidewall 138 can be equal to the distance between the second sidewall 132 and the fourth sidewall 140. In some examples, the distance between the first sidewall 130 and the third sidewall 138 can be greater than or less than the distance between the second sidewall 132 and the fourth sidewall 140. In some embodiments, the distance between the first sidewall 130 and the third sidewall 138, or the distance between the second sidewall 132 and the fourth sidewall 140, can be zero (e.g., no gap in between).

Figure 2:
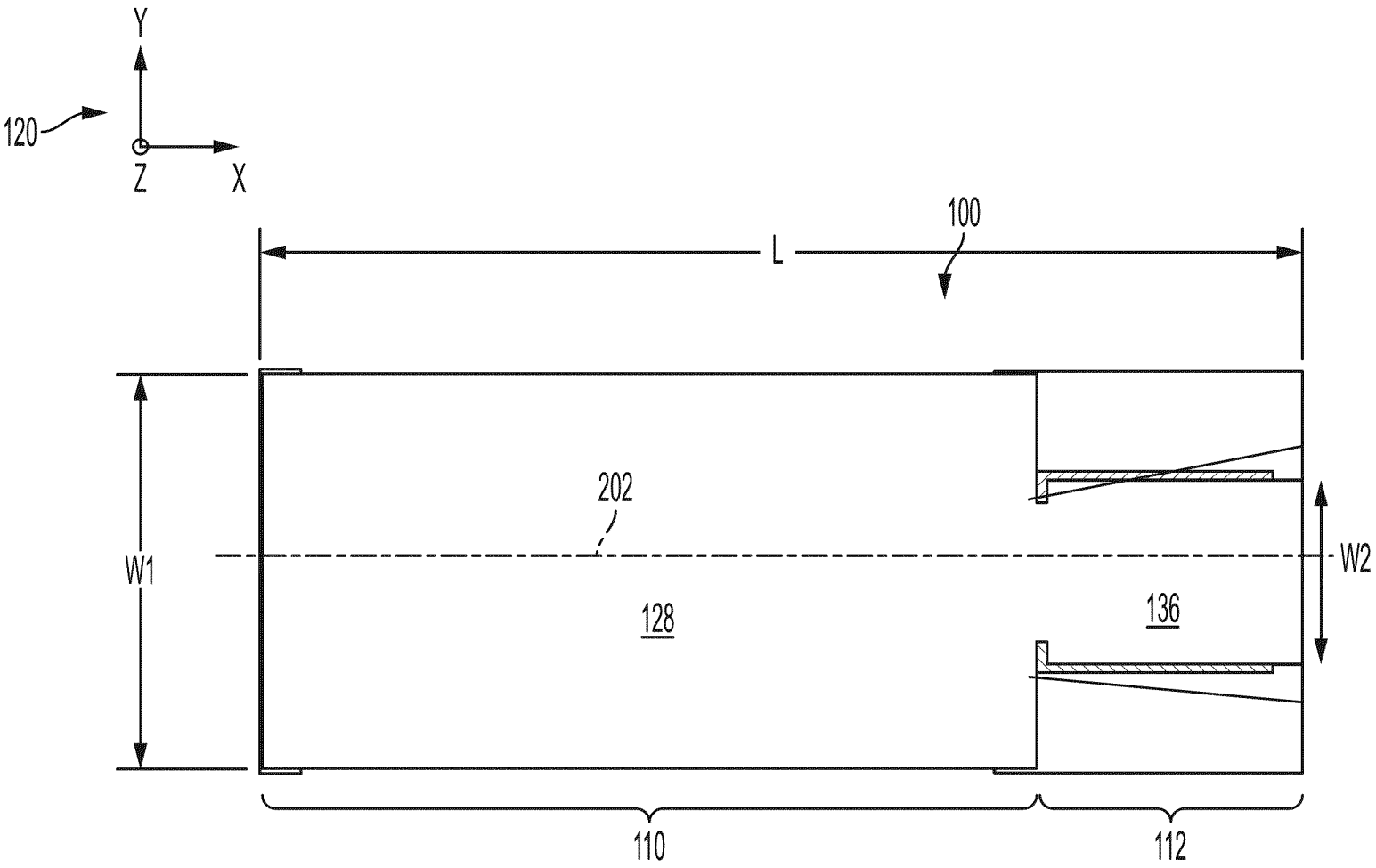
FIG. 2 shows a top view of the cover shown in FIG. 1.

FIG. 2 shows a top view of the cover 104 shown in FIG. 1. The cover 104 can have a length L that is a sum of the length L1 of the first portion 110 and the length L2 of the second portion 112 of the cover 104. The first top plate 128 and the second top plate 136 can have rectangular shapes. In some examples, the first top plate 128 and/or the second top plate 136 can have shapes other than rectangular shapes, such as for example, circular, elliptical, polygonal (regular or irregular), etc. The first width W1 of the first portion 110 is greater than the second width W2 of the second portion 136. In one example, the first portion 110 and the second portion 112 can have a same longitudinal axis 202. The longitudinal axis 202 can be a line that passes through a center of the first portion 110 and the second portion 112. In some instances, a longitudinal axis of the first portion 110 may not coincide with a longitudinal axis of the second portion 112. For example, the center of the second portion 112 can be offset from the center of the first portion 110 along the width of the first portion 110 (or along the y-axis). As an example, the length L of the cover 104 can be between 0.56 inches and 1 inch. As an example, the first length L1 of the first portion 110 can be between 0.38 inches and 0.6 inches. As an example, the first width W1 of the first portion 110 can be between 0.2 inches and 0.4 inches. As an example, the second length L2 of the second portion 112 can be between 0.1 inches and 0.4 inches. As an example, the second width W2 of the second portion 112 can be between 0.1 inches and 0.2 inches.

In some instances, the cover 104 can be formed using a conductive material, such as for example, stainless steel, copper, aluminum, metal alloys, etc. In some instances, the first portion 110 of the cover 104 can be formed of the same material as the second portion 112.

Figure 4:
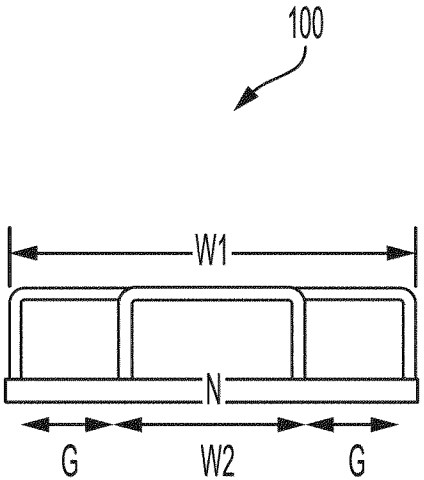
FIG. 4 shows a second side view of the RF device shown in FIG. 1.
Figure 3:
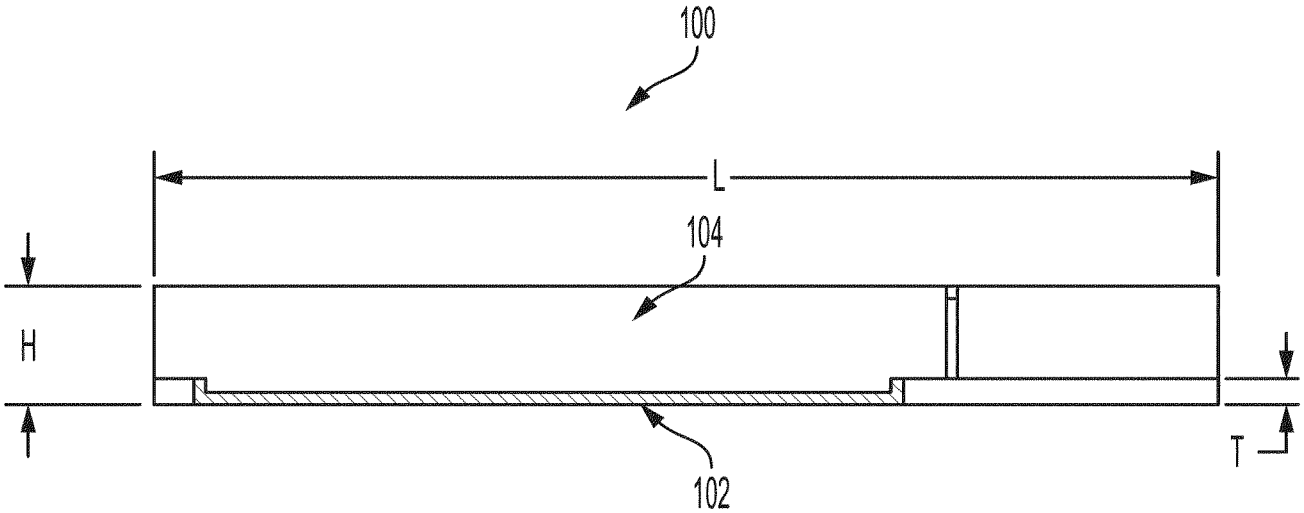
FIG. 3 shows a first side view of the RF device shown in FIG. 1.

FIG. 3 shows a first side view of the RF device 100 shown in FIG. 1 along a direction A. FIG. 4 shows a second side view of the RF device 100 shown in FIG. 1 along a direction B. The substrate 102 can have a thickness T measured as a distance between the first surface 106 and the second opposing surface of the substrate 102. The thickness T can have a value between 0.005 inches and 0.03 inches. In some instances, the thickness T of the substrate 102 can be uniform over the entire substrate 102. In some other instances, the thickness T of the substrate 102 can be non-uniform. The cover 104 can have a height H, measured as a distance between the first surface 106 of the substrate 102 and the first top plate 128 (or the upper surface of the first top plate 128). As an example, the height H can have a value between 0.07 and 1.1 inches. The first portion 110 and the second portion 112 of the cover 104 can have uniform height H. That is the distance between the first surface 106 of the substrate 102 and the second top plate 136 (or the upper surface of the second top plate 136) is equal to H. In some other instances, the height of the first portion 110 can be different from the height of the second portion 112. In some instances, the height of the first portion 110 can be greater than the height of the second portion 112. In some other instances, the height of the first portion 110 can be less than the height of the second portion 112. In some instances, the height of the first portion 110 can be uniform throughout the surface area of the first top plate 128. In some other instances, the height of the first portion 110 can be non-uniform. In some instances, the height of the second portion 112 can be uniform throughout the surface of the second top plate 136. In some other instances, the height of the second portion 112 can be non-uniform.

Figure 5:
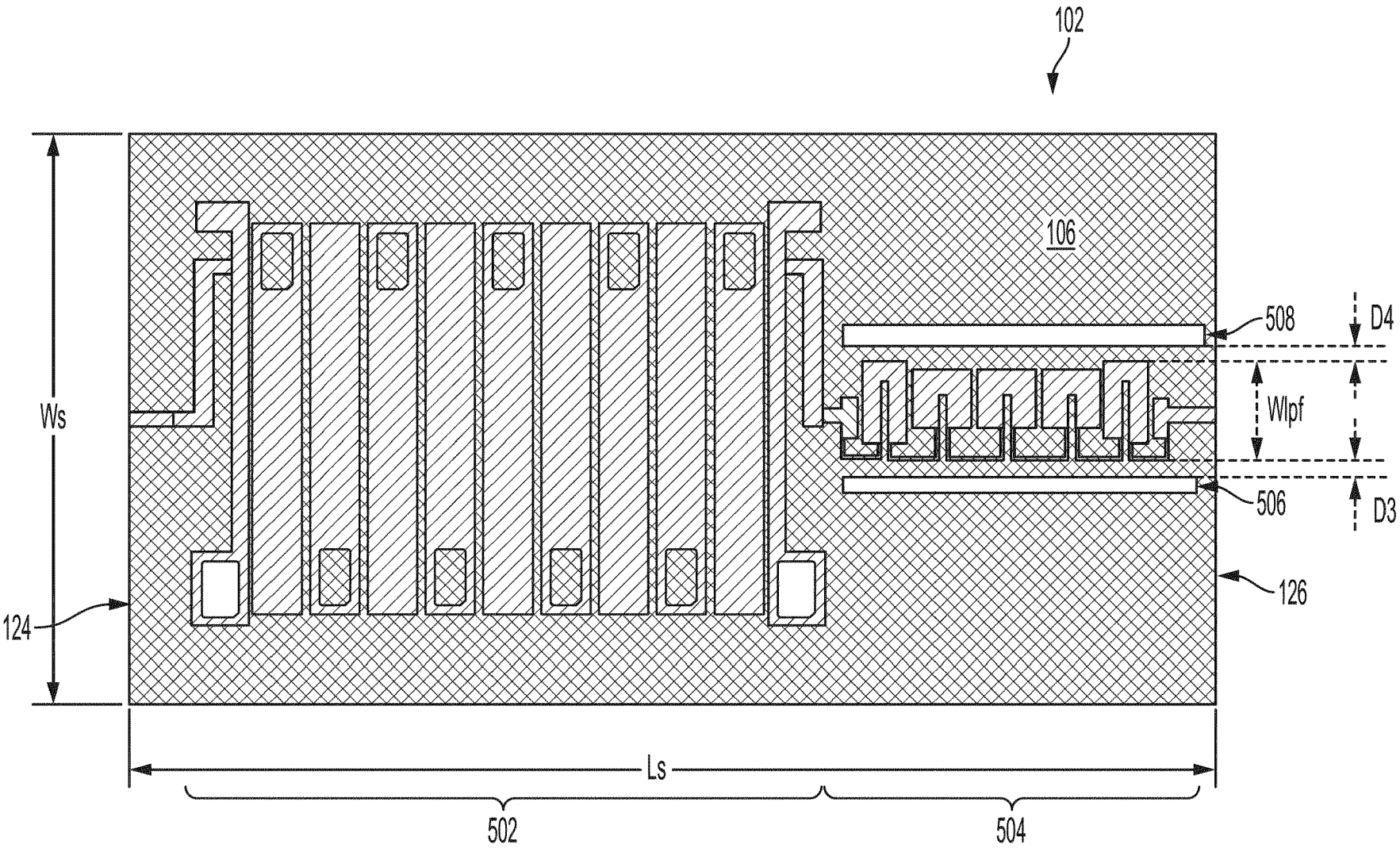
FIG. 5 shows a top view of a substrate of the RF device shown in FIG. 1.

FIG. 5 shows a top view of the substrate 102. The substrate 102 can include two or more RF components. For example, the substrate includes a first RF component 502 and a second RF component 504. As an example, the first RF component 502 can be a band-pass filter and the second RF component 504 can be a low-pass filter (or another filter, such as another band-pass filter). Assuming the first RF component 502 includes a band-pass filter, the first RF component 502 can be an interdigital band-pass filter having a series of resonators, for example. Each resonator of the interdigital band-pass filter can be a quarter wave resonator, which can include one open circuit end and one short circuit end. The short circuit end of the resonator can be connected to the ground plane of the substrate 102. For example, vias can be formed on the substrate to connect the short circuit ends to the ground plane formed on the opposing second end of the substrate 102. In some instances, the vias can be plated with gold or filled with a conductive material. In some instances, the vias can be filled with a non-conductive material such as, for example, epoxy, to prevent solder from flowing through the via to the first surface 106 during a mounting process of the substrate 102. The dimensions of the resonators can be based on the desired frequency, dielectric constant, and thickness T of the substrate 102. Assuming the second RF component 504 includes a low-pass filter for example, the second RF component 504 can include a series of resonators that result in a low-pass frequency response of the low-pass filter.

The cover 104 can be positioned over the first and the second RF components 502 and 504. In particular, the second portion 112 of the cover 104 can be positioned over the second RF component 504. The substrate 102 can define a first slot 506 and a second slot 508 that can accommodate the third sidewall 138 and the fourth sidewall 140 of the second portion 112 of the cover 104. In some instances, the first and second slots 506 and 508 can be vias that electrically connect the third and fourth sidewalls 138 and 140, respectively, to a ground plane on the opposing second surface of the substrate 102. In some instances, the first and second slots 506 and 508 can be through holes that extend between the first surface 106 and the opposing second surface of the substrate 102. In some such instances, the third and fourth sidewalls 138 and 140 can extend through the through holes.

The substrate 102 can be formed using non-conductive materials such as ceramics, while the first and second RF components 502 and 504 can be formed using conductive materials such as copper, aluminum, silver, gold, etc. In some examples, the first and second RF components 502 and 504 can be formed using microstrip transmission lines that are separated from a ground plane by the substrate 102. In some instances, the microstrip transmission lines can be formed on the first surface 106 of the substrate 102. In some instances, the microstrip transmission lines can be formed at least partially embedded within the substrate 102.

In one example, the width W2 of the second portion 112 (FIG. 1) can be a function of the width Wlpf of the second RF component 504. For example, a distance of at least D3 can be maintained between the third sidewall 138 and the nearest perimeter of the second RF component 504, and a distance of at least D4 can be maintained between the fourth sidewall and the nearest perimeter of the second RF component 504. In some instances, the distance D3 and D4 can be at least 0.008 inches or at least 0.2 mm. In some instances, the suppression offered by the low-pass filter can be an inverse function of the distances D3 and D4, such that the degree of suppression can increase with a decrease in the value of D3 and D4. The reduction in the values of D3 and D4 reduce the width of the second cavity 142, which in turn can increase the degree of suppression or attenuation offered by the low-pass filter. In contrast, some approaches to designing covers 104 use a uniform width cover, where the width of the cover is uniform over the first RF component 502 and the second RF component 504. Such uniform width covers have a uniform cavity for both the band-pass filter and the low-pass filter. The wide cavity associated with the low-pass filter results in a reduced degree of suppression provided by the low-pass filter. The RF device 100 shown in FIGS. 1-5 instead uses a narrower cavity for the low-pass filter, which results in improved suppression. The narrower cavity shifts the box mode or waveguide mode of the low-pass filter to higher frequencies, thereby increasing the suppression at those frequencies.

As mentioned above, the frequency response of the band-pass filter can have repeated pass-bands at frequencies higher than the desired pass-band. Such high frequency pass-bands can be referred to as harmonics, and can undesirably introduce high frequency components of the input signal into the output signal. A low-pass filter can be used to suppress the signals resulting from the harmonics. However, the low-pass filters with uniform width covers can be inadequate in suppressing the signals resulting from the harmonics. By including the non-uniform width cover 104 discussed above, the suppression offered by the low-pass filter can be improved (e.g., from 20 dB to 40 dB or more), thereby increasing the suppression of undesirable signals resulting from harmonics. In some examples, the band-pass filter can be positioned after the low-pass filter. That is, the input signal is first processed by the low-pass filter, and the output of the low-pass filter is fed to the band-pass filter. The sequence of the RF components may not affect the combined frequency response of the combined RF device.

Figure 6:
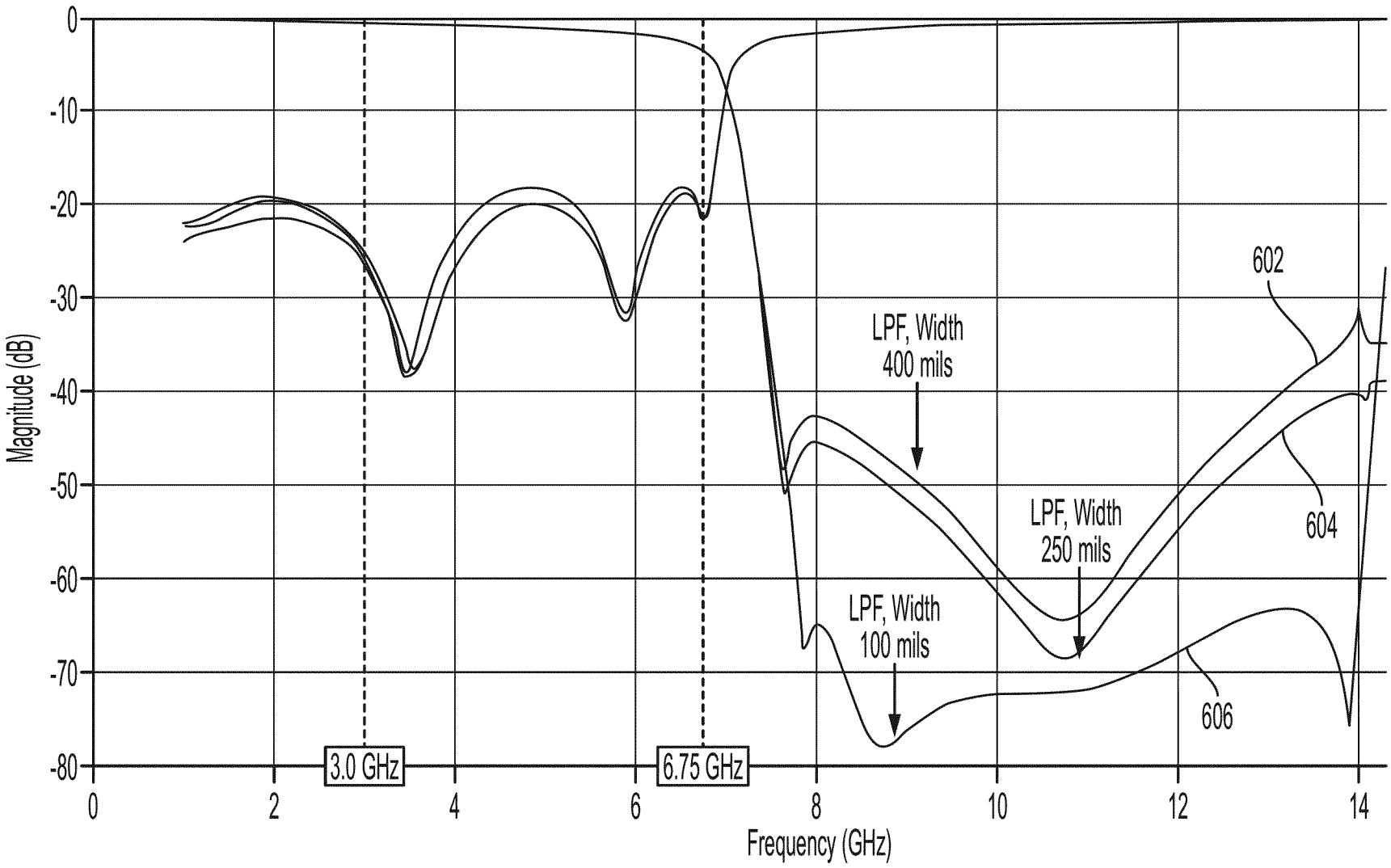
FIG. 6 shows frequency response curves of a low-pass filter for different widths of the cover, according to embodiments of the present disclosure.

FIG. 6 shows frequency response curves of a low-pass filter for different widths of the cover. In particular, FIG. 6 shows the response curve for different widths W2 of the second portions 112 of the cover 104. The cut-off frequency of the low-pass filter is set to about 6.76 GHz, and can be set to be below the harmonics of the band-pass filter. FIG. 6 shows an illustrative embodiment of a first low-pass response curve 602 corresponding to a width W2=400 mils (thousandths of an inch), a second low-pass response curve 604 corresponding to a width W2=250 mils, and a third low-pass response curve 606 corresponding to a width W2=100 mils. The suppression offered by the low-pass filter increases with the decrease in the width W2. For example, a reduction in the width by 300 mils results in an improvement in the suppression of about 40 dB in the frequency range of 9 GHz to 14 GHz. This is evident from the difference in the magnitude of suppression, in the frequency range of 9 GHz to 14 GHz, between the first low-pass response curve 602 corresponding to a width W2=400 mils and the third low-pass response curve 606 corresponding to a width W2=100 mils, for instance. On average, within the range of 7.75 GHz and 14 GHz, a reduction in the width W2 of about 300 mils can result in an increase in the magnitude of suppression by about 25 dB. In one aspect, reducing the width W2 shifts the box mode or waveguide mode of the low-pass filter to higher frequencies, thereby increasing the suppression at those frequencies.

Figure 7:
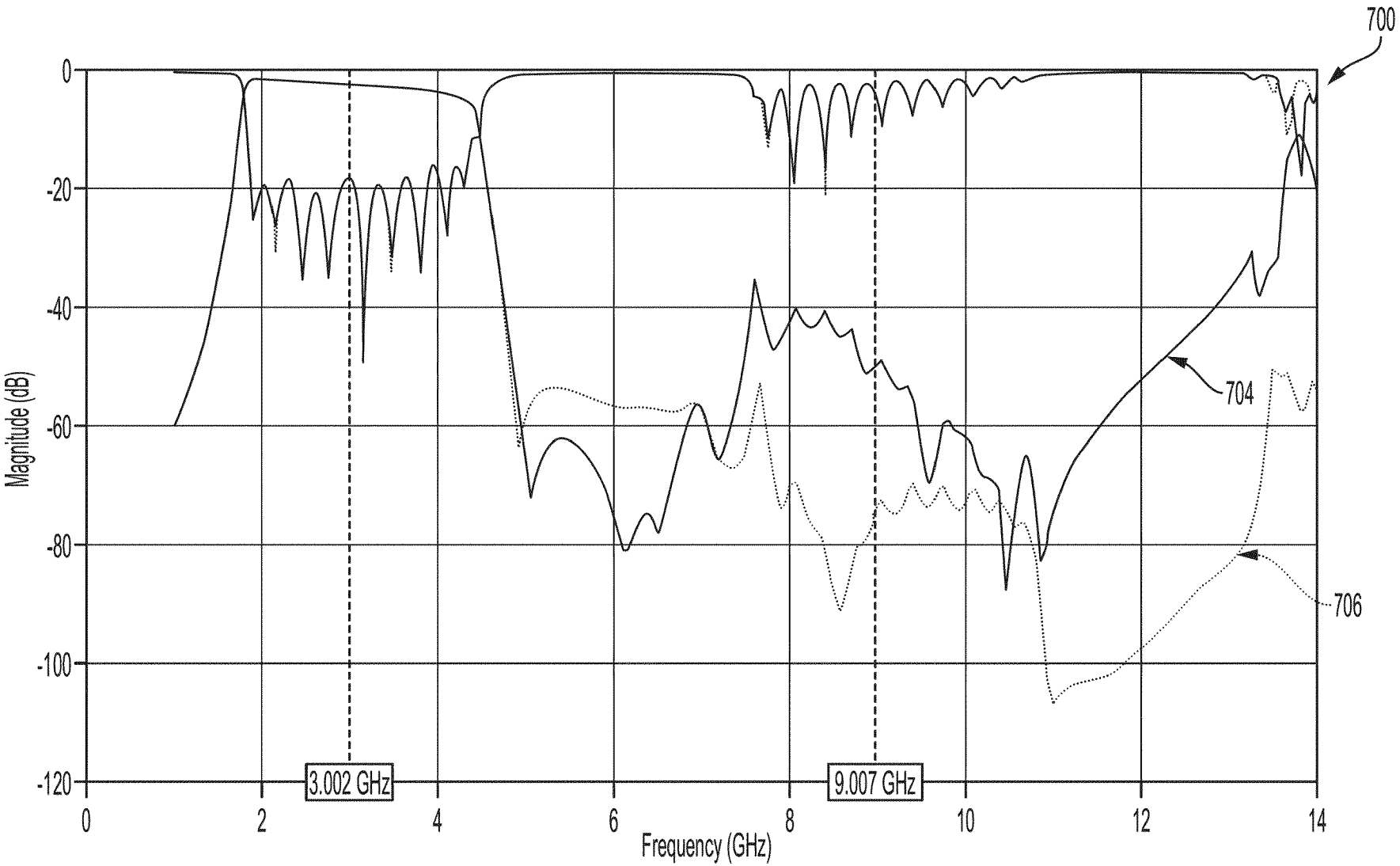
FIG. 7 shows a response curve of an RF device including a band-pass filter followed by a low-pass filter using the non-uniform width cover shown in FIG. 1 according to embodiments of the present disclosure.

FIG. 7 shows a response curve of an RF device including a band-pass filter followed by a low-pass filter using a non-uniform cover 104 that is for example shown in FIG. 1. The first curve 704 and the second curve 706 correspond to the combined frequency responses of the band-pass filter and the low-pass filter with a uniform width cover and a non-uniform width cover, respectively. In particular, the first curve 704 corresponds to a second width W2 of the second portion 112 of the cover 104 set at 400 mils while the second curve 706 corresponds to the second width W2 set at 100 mils. The suppression in the frequency range of about 7.75 GHz to 14 GHz associated with the second curve 706 is greater than that associated with the first curve 704.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A radio frequency (RF) device, comprising a substrate having a first surface and an opposing second surface;

a first RF component supported by the first surface of the substrate, the first RF component comprising a band-pass filter exhibiting one or more harmonics in a first frequency range;

a second RF component supported by the first surface of the substrate and electrically coupled to the first RF component in series, the second RF component comprising a low-pass filter having a cut-off frequency below the first frequency range; and a cover disposed over the first surface of the substrate, the cover including:

a first portion having a first width and covering the first RF component, the first portion and the first surface define a first waveguide cavity having the first width, and a second portion having a second width, less than the first width, and covering the second RF component, the second portion and the first surface define a second waveguide cavity having the second width.

2. The RF device of claim 1, wherein the first portion of the cover and the second portion of the cover have a first height and a second height, respectively, in relation to the first surface of the substrate, and wherein the first height is equal to the second height.

3. The RF device of claim 1, wherein the first width has a value between 0.2 inches and 0.4 inches, and the second width has a value between 0.1 inches and 0.4 inches.

4. The RF device of claim 1, wherein the first portion of the cover includes a first sidewall and a second sidewall, and wherein the second portion includes a third sidewall and a fourth sidewall.

5. The RF device of claim 4, wherein the first sidewall is separated from the third sidewall by a first gap.

6. The RF device of claim 5, wherein the second sidewall is separated from the fourth sidewall by a second gap.

7. The RF device of claim 6, wherein the first gap is equal to the second gap.

8. The RF device of claim 4, wherein the first sidewall is continuous with the third sidewall.

9. The RF device of claim 8, wherein the second sidewall is separated from the fourth sidewall by a gap.

10. The RF device of claim 4, wherein the first surface of the substrate defines a first slot and a second slot, and wherein at least a portion of the third sidewall is disposed in the first slot and at least a portion of the fourth sidewall is disposed in the second slot.

11. The RF device of claim 10, wherein the first sidewall and the second sidewall are separated from a perimeter of the first RF component by at least a first distance.

12. The RF device of claim 11, wherein the first distance is at least 0.008 inches.

13. The RF device of claim 4, wherein the substrate includes a ground plane disposed on the second surface.

14. The RF device of claim 13, wherein the substrate includes:

a plurality of side surfaces that extend between the first surface and the opposing second surface; and conductive material disposed on at least a portion of the plurality of side surfaces, the conductive material electrically connected to the ground plane.

15. The RF device of claim 14, wherein at least a portion of the first sidewall and at least a portion of the second sidewall are in contact with the conductive material.

16. The RF device of claim 4, wherein the first portion includes a first top plate that extends between the first sidewall and the second sidewall, the first top plate covering the first RF component.

17. The RF device of claim 16, wherein the second portion includes a second top plate that extends between the third sidewall and the fourth sidewall, the second top plate covering the second RF component.

18. The RF device of claim 17, wherein the first top plate is continuous with the second top plate.

* * * * *